US008141729B2

(12) United States Patent
Scarlata

(10) Patent No.: US 8,141,729 B2
(45) Date of Patent: Mar. 27, 2012

(54) CONVERTIBLE CLOSURE FOR A CONTAINER

(75) Inventor: Thomas J. Scarlata, San Clemente, CA (US)

(73) Assignee: The Thomas J. & Kathleen Scarlata Living Trust, San Clemente, CA (US)

( * ) Notice: Subject to any disclaimer, the term of this patent is extended or adjusted under 35 U.S.C. 154(b) by 540 days.

(21) Appl. No.: 12/269,275

(22) Filed: Nov. 12, 2008

(65) Prior Publication Data

US 2009/0120896 A1 May 14, 2009

Related U.S. Application Data

(60) Provisional application No. 60/987,465, filed on Nov. 13, 2007.

(51) Int. Cl.

| | |
|---|---|
| ***A61J 1/00*** | (2006.01) |
| ***A61J 1/03*** | (2006.01) |
| ***B65D 50/00*** | (2006.01) |
| ***B65D 55/02*** | (2006.01) |

(52) U.S. Cl. ..... 215/220; 215/201; 215/217; 215/218

(58) Field of Classification Search ..... 215/201, 215/217, 218, 220

See application file for complete search history.

(56) References Cited

U.S. PATENT DOCUMENTS

| | | | | |
|---|---|---|---|---|
| 3,850,326 | A | 11/1974 | Ryles | |
| 4,042,105 | A | 8/1977 | Taylor | |
| 4,444,326 | A | 4/1984 | Musel | |
| 4,832,218 | A | 5/1989 | Gibilisco | |
| 5,433,329 | A | 7/1995 | Weinstein | |
| 5,579,934 | A | 12/1996 | Buono | |
| 5,678,712 | A * | 10/1997 | Rios | 215/220 |
| 5,711,442 | A | 1/1998 | Kusz | |
| 5,732,836 | A * | 3/1998 | Barker et al. | 215/230 |
| 5,899,348 | A | 5/1999 | Konefal | |
| 6,039,195 | A | 3/2000 | Konefal | |
| 7,942,280 | B2 | 5/2011 | Priebe | |

* cited by examiner

*Primary Examiner* — Anthony Stashick
*Assistant Examiner* — Madison L Wright
(74) *Attorney, Agent, or Firm* — Lucas & Mercanti, LLP

(57) ABSTRACT

Convertible closure for a container includes an outer closure member having a first child-resistant portion on an inner surface, a first inner closure member having an inner surface arranged to engage with a neck of the container and a second child-resistant portion arranged to selectively engage with the first child-resistant portion on the outer closure member, and a second inner closure member arranged to engage with both the outer closure member and the first inner closure member. The selective engagement of the first and second child-resistant portion is designed so that when engaged, the closure has a non-child resistant configuration (only grasping and rotation of the outer closure member is sufficient to twist the closure out of engagement with the container) and when not engaged therewith, the closure has a child-resistant configuration (grasping, rotation and downward pressure is required to remove the closure from engagement with the container).

28 Claims, 4 Drawing Sheets

CONVERTIBLE CLOSURE FOR A CONTAINER

CROSS-REFERENCE TO RELATED APPLICATION

This application claims the benefit of priority from U.S. Provisional Application Ser. No. 60/987,465 filed Nov. 13, 2007, the contents of which are incorporated herein by reference.

FIELD OF THE INVENTION

The present invention relates generally to a closure for a container that is selectively convertible or adjustable between a configuration or mode in which it is difficult to be opened by children or elderly people, i.e., a child-resistant configuration or mode, and a configuration or mode in which it can be easily opened by children or elderly people without significant force and without requiring special dexterity.

BACKGROUND OF THE INVENTION

Child-resistant closures for containers are well-known and understood to be effective in preventing inadvertent access to potentially dangerous materials, such as prescription medications in such containers, by children. However, such child resistant closures poses problems for elderly people and others with reduced manual dexterity in that it becomes difficult for them to manipulate the closure in order to open the container.

Therefore, although it would be socially desirable to have all medication containers include a child-resistant closure, it is not consider possible to implement this in view of the need to dispense medication to elderly people and others with reduced manual dexterity who might be unable to open a container with a child-resistant closure.

Therefore, convertible container closures have been developed which can be used in both a child-resistant mode and a non-child-resistant mode. For example, U.S. Pat. No. 5,579,934 (Buono) describes a convertible child resistant closure for use with a container having a threaded portion adjacent the container opening, e.g. the container neck, to allow a user to select between a child-resistant configuration and a non-child-resistant configuration. The closure includes coaxial inner and outer caps. The inner cap is defined by a cover wall and a side wall or skirt depending from the cover wall. The side wall includes an inner surface having a threaded portion for engagement with the threaded neck portion of the container and an outer surface including a child resistant portion comprising a series of angular abutments extending thereabout and a non-child resistant portion axially offset from the child resistant portion and preferably in the form of a row of longitudinally extending knurlings. The outer cap is also defined by a cover wall and a side wall depending from the cover wall. The side wall includes an inner surface divided into a first child resistant portion and a second non-child resistant portion axially offset from the first portion. The first portion includes a plurality of angular abutment surfaces complementary to the series of angular abutments on the inner cap and the second portion includes a row of longitudinal knurlings complementary to the knurlings on the inner cap. The inner cap member is positioned within the second cap member and is axially movable between a first position in which the angular surfaces of the inner cap engage the angular abutment surfaces on the outer cap to provide a child resistant closure and a second position in which the knurlings on the outer surface of the inner cap engage the knurlings on the inner surface of the outer cap to provide a non-child resistant closure.

Also, U.S. Pat. No. 5,114,029 (Gibilisco) describes a child resistant bottle closure including an inner cap member, an interlocking member and an outer cap member. The inner cap member includes threads which are secured to a bottle and includes external grooves on its outer circumferential surface. The interlocking member has pins projecting inwardly from its inner circumferential surface and pins projecting outwardly from its outer circumferential surface. The inwardly projecting pins engage and mate with the external grooves of the inner cap member thus securing the interlocking member to the inner cap member. The outer cap member includes grooves on an inner circumferential wall which mate and engage with the pins of the interlocking member. When in the upright position, the bottle cannot be opened (child-resistant mode) but when inverted, the interlocking member is moved and allows the bottle can be twisted and opened (non-child-resistant mode).

Further, U.S. Pat. No. 3,514,003 describes a two-piece closure having a selectably engageable locking device which is engaged or disengaged by axial movement of a collar member relative to a cap member. The cap and collar members have respective sets of teeth which interlock when the collar member is moved axially upwardly into its uppermost position. The neck of the bottle also includes teeth which engage the collar member when the collar member is in the uppermost position, thus preventing rotation of the closure. To unlock the closure, the collar member is slid downward and out of engagement with the cap member.

U.S. Pat. No. 5,148,931 describes a two-piece closure having two sets of axial channels on an inner cap and two sets of protrusions on an interior surface of an outer cap. The closure is opened by aligning the protrusions on the outer cap with the proper set of channels on the inner cap, pulling the outer cap up relative to the inner cap, and rotating the outer cap so as to interlock the outer and inner caps.

Additional patent literature that describes variable container closures includes U.S. Pat. No. 3,733,001 (Gach), U.S. Pat. No. 3,950,917 (Choksi et al), U.S. Pat. No. 4,393,977 (Willingham), U.S. Pat. No. 5,082,130 (Weinstein), U.S. Pat. No. 5,148,931 (Minh), U.S. Pat. No. 5,316,161 (Gargione), U.S. Pat. No. 6,085,920 (Moretti), U.S. Pat. No. 6,095,353 (Gargiulo et al), U.S. Pat. No. 6,802,427 (Miceli et al) and U.S. Pat. No. 7,111,746 (Miceli et al), and U.S. Pat. Appln. Publ. No. 2002/0027119 (Miceli et al).

OBJECTS AND SUMMARY OF THE INVENTION

It is an object of the present invention to provide a closure device for a container which is selectively convertible between a child resistant configuration or mode and a non-child-resistant configuration or mode allowing the user to select the mode of operation of the closure depending on, for example, the particular situation and environment in which the container is used. Thus, the closure device would be selectively convertible between a first position in which it resists opening by children and a second position in which it can readily be opened by adults, even adults having reduced manual dexterity.

In order to achieve this object and possibly others, a convertible closure for a container in accordance with the invention includes three main parts, namely, an outer closure member having a first child-resistant portion on an inner surface, a first inner closure member having an inner surface arranged to engage with a neck of the container and a second child-resistant portion arranged to selectively engage with the first child-resistant portion on the outer closure member, and a second inner closure member arranged to engage with both the outer closure member and the first inner closure member. The selective engagement of the first and second child-resistant portion is designed so that when engaged, the closure has a non-child resistant configuration (only grasping and rotation of the outer closure member is sufficient to twist the closure out of engagement with the container) and when not engaged therewith, the closure has a child-resistant configuration (grasping, rotation and downward pressure is required to remove the closure from engagement with the container).

The second inner closure member is structured and arranged relative to the outer closure member and the first inner closure member such that it enables the first inner closure member to be moved between a first position in which the first and second child-resistant portions are in engagement with one another (the non-child-resistant configuration) and a second position in the first and second child-resistant portions are not in engagement with one another (the child-resistant configuration). Further, in view of cooperation between the second inner closure member and the outer closure member, the second inner closure member is able to releasably retain the first inner closure member in a fixed position relative to the outer closure member when the first inner closure member is in the first position. Thus, the closure can be maintained in the non-child-resistant configuration unless intentionally altered into the child-resistant configuration.

In one embodiment, this requires an individual to press the second inner closure member downward, through an opening in the outer closure member which exposes the second inner closure member, against a retaining structure which retains the second inner closure member in the position in which the first inner closure member is in its first position to thereby release the second inner closure member from this fixed position and thus cause disengagement of the abutments on the first inner closure member from the abutments on the outer closure member. The retaining structure may be a circumferential lip formed on an inner surface of the outer closure member and a circumferential groove formed on an outer surface of the second inner closure member.

The first and second child-resistant portions may comprise one or more cooperating angular abutments.

To effect movement of the first inner closure member upon movement of the second inner closure member to its fixed position, in one embodiment, the first inner closure member includes a tubular body and a circumferential lip extending outward from the body at an upper edge region thereof while the second inner closure member includes a tubular body and a circumferential lip extending inward from the body at a lower edge region thereof. The circumferential lip of the second inner closure member which engages with and displaces the circumferential lip of the first inner closure member, and thus the first inner closure member, when urged into its fixed position to thereby move the first inner closure member into the first position.

Another embodiment of a convertible closure for a container in accordance with the invention includes an outer closure member having at least one angular abutment on an inner surface, a first inner closure member having an inner surface arranged to engage with a neck of the container and an outer surface including at least one angular abutment arranged to selectively engage with the angular abutments on the inner surface of the outer closure member, and a second inner closure member arranged to engage with the first inner closure member. The second inner closure member enables displacement of the first inner closure member between a first position in which the angular abutments on the outer surface of the first inner closure member are in engagement with the angular abutments on the inner surface of the outer closure member (the non-child-resistant configuration) and a second position in which the angular abutments on the outer surface of the first inner closure member are not in engagement with the angular abutments on the inner surface of the outer closure member (the child-resistant configuration). The same features of the first embodiment described above are applicable to this embodiment as well.

Yet another embodiment of a convertible closure for a container in accordance with the invention includes an outer closure member having a tubular body having an opening at an upper edge region and a plurality of angular abutments on an inner surface of the tubular body, and a first inner closure member having a tubular body, a structure for engaging with a neck of the container formed on an inner surface of the tubular body and a plurality of angular abutments formed on an outer surface of the tubular body and arranged to selectively engage with the angular abutments on the inner surface of the outer closure member. The closure also includes a second inner closure member which engages with first inner closure member and enables displacement of the first inner closure member between a first position in which the angular abutments on the outer surface of the first inner closure member are in engagement with the angular abutments on the inner surface of the outer closure member (the non-child-resistant configuration) and a second position in which the angular abutments on the outer surface of the first inner closure member are not in engagement with the angular abutments on the inner surface of the outer closure member (the child-resistant configuration). The second inner closure member is releasably retained, via cooperation between the second inner closure member and the outer closure member, in a position in which the first inner closure member is in the first position.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
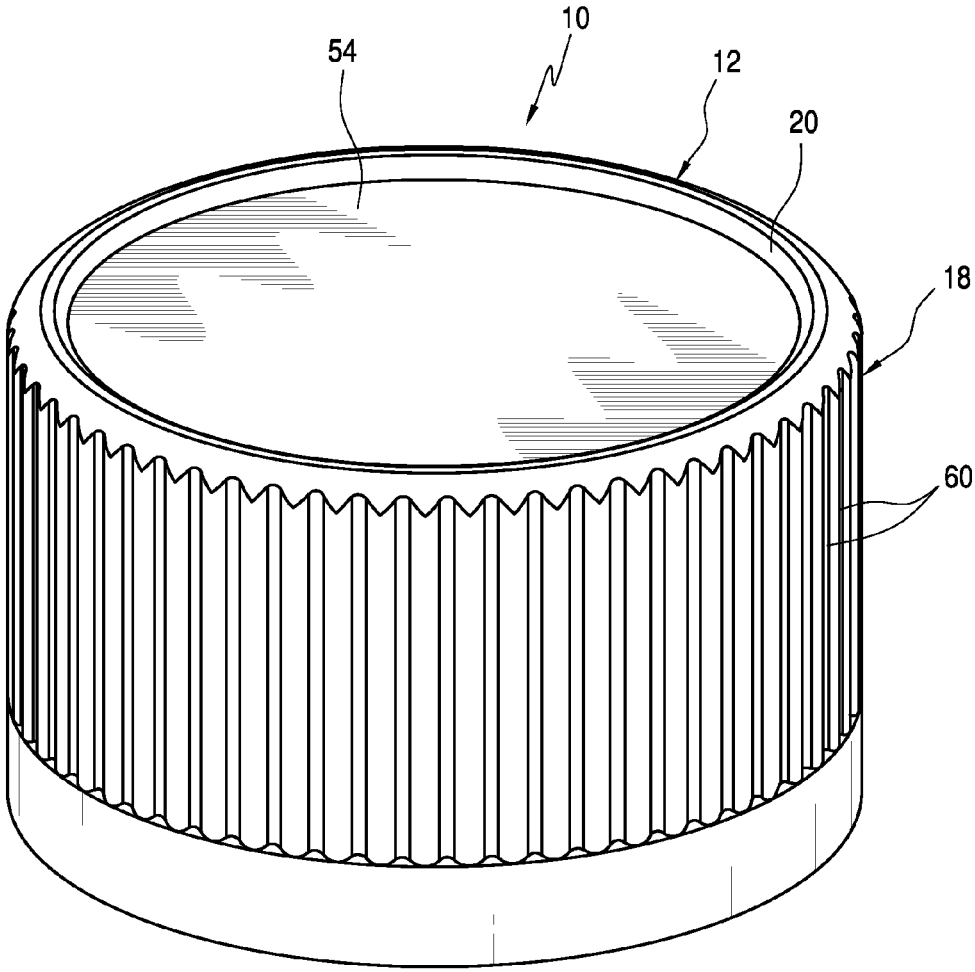
FIG. 1 is a perspective view of a container closure in accordance with the invention.

Referring to the accompanying drawings wherein like reference numerals refer to the same or similar elements, a convertible container closure in accordance with the invention is designated generally as 10 and includes three components, namely, an outer cap or closure member 12, an inner, lower closure member 14 and an inner, upper closure member 16. The outer closure member 12, inner, lower closure member 14 and inner, upper closure member 16 are substantially coaxial with one another.

Outer closure member 12 has a substantially tubular body 18, an upper peripheral lip 20 extending inward from a lower edge region of the body 18, a lower peripheral lip 22 extending inward from an upper edge region of the body 18, an intermediate peripheral lip 24 extending inward from a lower edge region of the body 18 between the upper and lower lips 20, 22 and a circumferential retaining lip 26 extending inward from the upper edge region of the body 18 but spaced apart from the upper lip 20 and shorter than the upper lip 20 (see FIGS. 4-7). As used herein, the term peripheral means that the lip extends around the entire inner circumference of the body 18, or at least a major portion of the inner circumference of the body 18 to the extent that the inner lower and upper closure members 14, 16 are securely retained between the upper and lower lips 20, 22 (in a manner described more fully below). The upper lip 20 defines a central opening 28 while the lower lip defines a central opening 30. The upper lip 20 defines the limit of movement of the inner, upper closure member 16.

Figure 6:
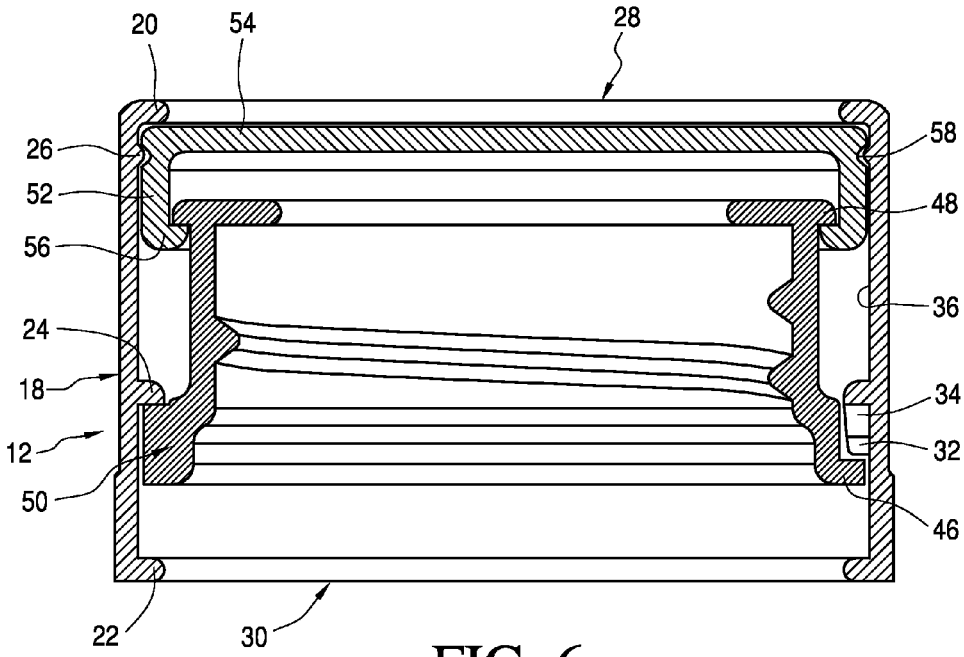
FIG. 6 is a cross-sectional view of the container closure shown in FIG. 1 when in a non-child-resistant mode.
Figure 7:
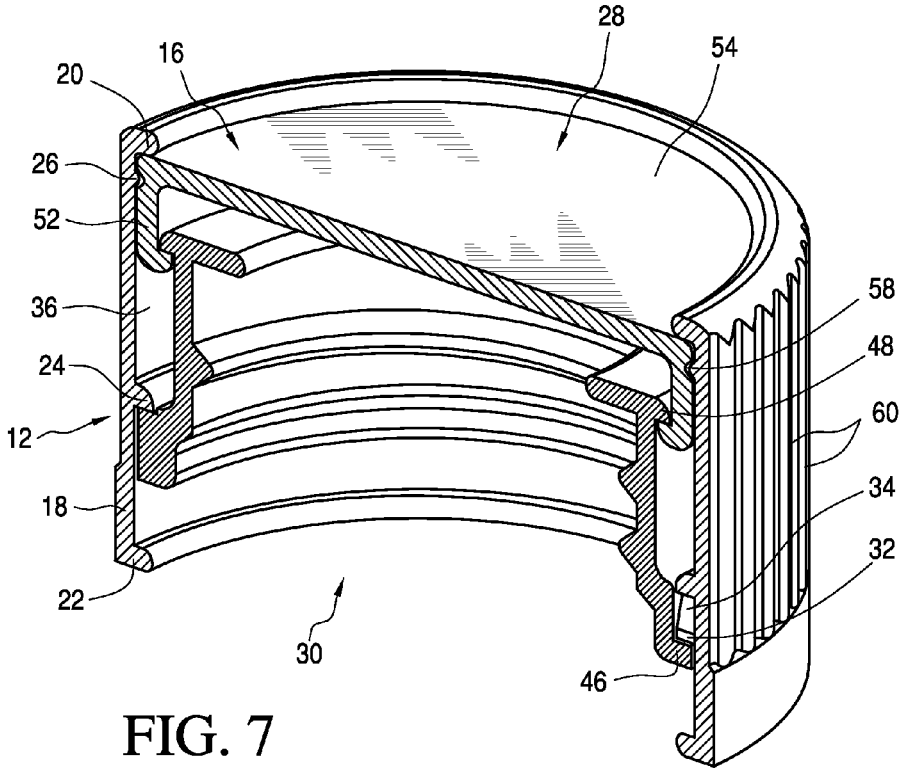
FIG. 7 is a perspective cross-sectional view of the container closure shown in FIG. 1 when in a non-child-resistant mode.

Retaining lip 26 is sufficiently deformable or flexible to enable the inner, upper closure member 16 to pass over and be securely held in an upper position shown in FIGS. 6 and 7 to provide the closure 10 with its non-child-resistant mode, yet also allow the inner, upper closure member 16 to be released from this position upon applying pressure thereto through the central opening 28. Retaining lip 26 thus serves as a yieldable stop.

Outer closure member 12 also includes an intermediate retaining structure 32 between the lower lip 22 and the retaining lip 26. Retaining structure 32 includes a child-resistant portion, e.g., plurality of angular abutments or wedge-shaped elements 34 formed on the inner circumferential surface 36 of the body 18. The intermediate peripheral lip 24 serves as an inwardly-extending, intermediate support lip or ledge formed above the angular abutments 34.

Figure 2:
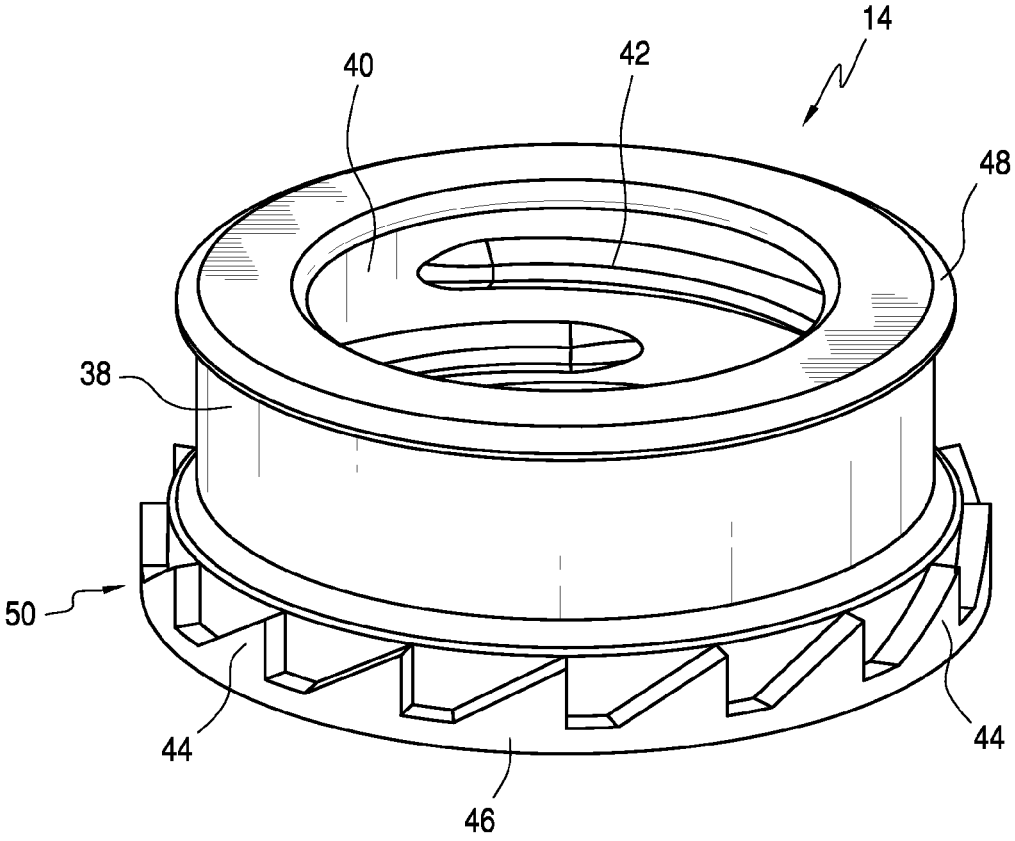
FIG. 2 is a perspective view of an inner, lower closure member in the container closure shown in FIG. 1.

The lower, inner closure member 14, best seen in FIG. 2, has a substantially tubular body 38 having an inner surface 40 arranged to engage with a neck of the container, e.g. via a thread 42, and a child-resistant portion, i.e., angular abutments 44, arranged on an outer surface to selectively engage and cooperate with the angular abutments 34 of the outer closure member 12. When angular abutments 34 and 44 are engaged, the closure 10 has a non-child-resistant position or configuration and requires only grasping and twisting of the closure 10 relative to the container to remove the closure 10 from the container (since twisting of the outer closure member 12 translates into rotation of the inner, lower closure member 14 engaged therewith via the cooperating angular abutments 34, 44), this position being shown in FIGS. 6 and 7. When angular abutments 34 and 44 are not engaged with one another, the closure 10 has a child-resistant position or configuration in which grasping, twisting and application of downward axial pressure on the outer closure member 12 is required to remove the closure 10 from the container, this position being shown in FIGS. 4 and 5. In this case, it is necessary to first bring the angular abutments 34 on the outer closure member 12 into engagement with the angular abutments 44 on the inner, lower closure member 14 in order to transmit rotative force applied to the outer closure member 12 into rotative force applied to the inner, lower closure member 14.

Instead of angular abutments 34, 44, other mechanisms for forming a child-resistant configuration of a closure may be used in accordance with the invention. Similar structures may be known in the art as teeth, angularly extending abutment surfaces and the like. Each angular abutment 34 includes a pair of surfaces angled downward from the intermediate lip 24 forming a substantially triangular form. Similarly, each angular abutment 44 may include a pair of surfaces angled upward from a support ledge 46 forming a substantially triangular form. The number of angular abutments 34, 44 may vary as desired. The ratio of angular abutments 34 to angular abutments 44 may vary as well, whereby there may be more angular abutments 34 than angular abutments 44, an equal number of angular abutments 34 and 44 or more angular abutments 44 than angular abutments 34. The number of angular abutments 34 does not have to equal to the number of angular abutments 44, or even multiples of each other. Rather, the angular abutments 34 should preferably have equivalent spacing as angular abutments 44, i.e., whichever angular abutments 34, 44 are fewer, they are spaced such that any gap between adjacent abutments is the same size as a real abutment that corresponds to all of the abutments on the other member.

The inner, lower closure member 14 also includes a circumferential lip 48 extending outward from the body 38 at an upper edge region thereof, the purpose of which is explained below. Angular abutments 44 and support ledge 46 are formed on an outer surface of an abutment portion 50 which extends outward from the body 38 at a lower edge region. Abutment portion 50 is brought close to and possibly into contact with the intermediate lip 24 of the outer closure member 12 when the inner, lower closure member 14 is in the non-child-resistant position (see FIGS. 6 and 7).

Figure 3:
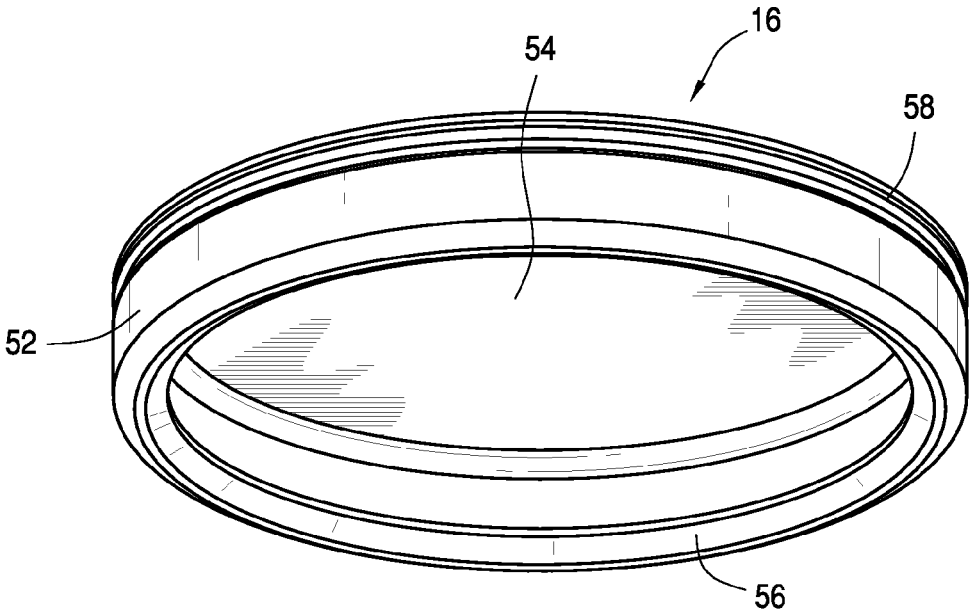
FIG. 3 is a perspective view of an inner, upper closure member in the container closure shown in FIG. 1.

Inner, upper closure member 16, best seen in FIG. 3, is arranged to engage with both the outer closure member 12 and the inner, lower closure member 14. An outer surface of the inner, upper closure member 16 faces and is alongside the inner surface 36 of the body 18 of the outer closure member 12 while an inner surface of the inner, upper closure member 16 selectively faces part of the outer surface of the inner, lower closure member 14.

Inner, upper closure member 16 has a particular construction and interrelationship with the outer closure member 12 and inner, lower closure member 14 which enables the inner, lower closure member 14 to be moved between a first, non-child-resistant position in which the angular abutments 34, 44 are in engagement with one another and a second, child-resistant position in the angular abutments 34, 44 are not in engagement with one another. Specifically, the inner, upper closure member 16 includes a tubular body 52, a circular top wall 54 and a circumferential lip 56 extending inward from the body 52 at a lower edge region thereof. The circumferential lip 56 engages with the circumferential lip 48 of the inner, lower closure member 14, and thus the inner, lower closure member 14, when it is urged upward to thereby move the inner, lower closure member 14 into its non-child-resistant position shown in FIGS. 6 and 7

The inner, upper closure member 16 also includes structure for releasably retaining the inner, lower closure member 14 in a fixed position relative to the outer closure member 12 when the inner, lower closure member 14 is in the non-child-resistant position shown in FIGS. 6 and 7. Specifically, a circumferential groove 58 is formed on the outer surface of the inner, upper closure member 16 and cooperates with the retaining lip 26 to allow the inner, upper closure member 16 to be retained in the position shown in FIGS. 4 and 5. However, the inner, upper closure member 16 can be removed from this position by manually urging it downward, e.g., by exerting pressure against the top wall 54 through the opening 28 in the outer closure member 12.

Variations to the foregoing structure are envisioned. For example, the outer closure member 12 is shown incorporating optional serrations 60 on the outer surface of the body 18 for ease in gripping and rotating the outer closure member 12. The serrations 60 preferably extend vertically along the length of the body 18 and may be positioned about the entire circumference of the body 18, or alternatively, only selected portions thereof.

Figure 4:
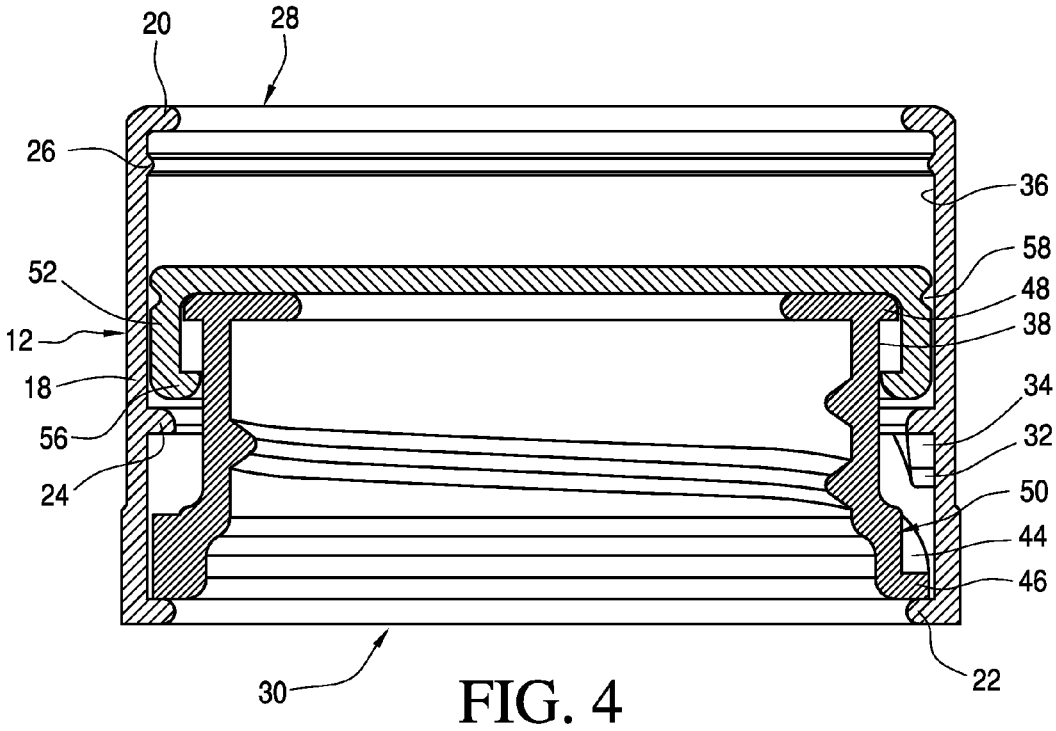
FIG. 4 is a cross-sectional view of the container closure shown in FIG. 1 when in a child-resistant mode.
Figure 5:
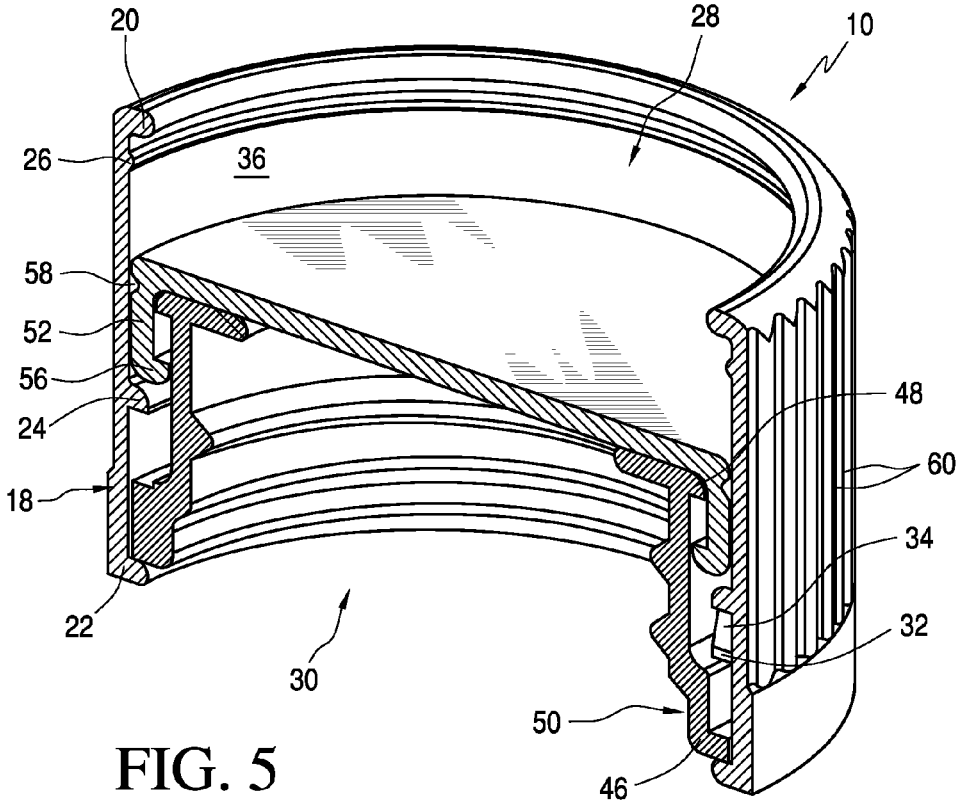
FIG. 5 is a perspective cross-sectional view of the container closure shown in FIG. 1 when in a child-resistant mode.

Operation of the convertible closure 10 of the invention will now be described. Prior to mounting of the closure 10 onto a container, it is determined whether the closure 10 is to have a child-resistant configuration or a non-child-resistant configuration. In the former case, the inner, upper closure member 16 is urged downward out of engagement with the retaining lip 26 and is thus movable or slidable between the outer closure member 12 and the inner, lower closure member 14 (as shown in FIGS. 4 and 5). This movement is limited in the upward direction by the upper lip 20 and in the downward direction by the retaining lip 26. The closure 10 is then placed on the threaded neck portion of the container by threadedly engaging the thread 40 on the inner, lower closure member 14 with the threaded portion of the container. A rotative force turns the outer closure member 12 in the closing direction, i.e., clockwise. Vertical surfaces of the angular abutments 44 on the inner, lower closure member 14 and abutment surfaces 34 on the outer closure member 12 interengage to cause the inner, lower closure member 14 and the outer closure member 12 to turn together, e.g. to cause the inner, lower closure member 14 to remain rotationally stationary relative to the outer closure member 12, to close the container. Upon closing the container, further rotation of the closure 10 in the closing direction is prevented. Rotation of the closure 10 in the opposite direction will cause the abutment surfaces 34 of the outer closure member 12 to ratchet or ride over the abutments surfaces 44 of the inner, lower closure member 14. Thus, turning of the outer closure member 12 in the opening direction will not rotate inner, lower closure member 14 in an opening direction because there is no transmission of torque from the outer closure member 12 to the inner, lower closure member 14 because the angular abutments 34 ride over and slide by the angular abutments 44.

In order to open the closed container with closure 10 in a child resistant mode, the user must utilize both a rotative and an axial force. It is the axial force that prevents the angular abutments 34 of the outer closure member 12 from ratcheting or riding up and over angular abutments 44 of the inner, lower closure member. Thus, when the outer closure member 12 is rotated in an opening direction, i.e., counterclockwise, with the use of both rotational and axial force, the angular abutments 34 of the outer closure member 12 are prevented from ratcheting over angular abutments 44 but instead engage one another to transmit torque between angular abutments 34 and 44 to thereby rotate the inner, lower closure member 14 causing it to disengage from the threaded portion of the container. Accordingly, the closure 10 is disengaged from the container and the container is open.

If the closure 10 is to be installed on a container in the non-child-resistant position, then the inner, upper closure member 16 is urged upward until it is retained by the retaining lip 26, in which case, the angular abutments 34 and 44 would be in engagement with one another.

This is a presently preferred form for effecting the child resistant feature of the present invention. Of course, other means for drivingly connecting the inner, lower closure member and outer closure member relative to one another may be employed without departing from this invention.

Containers which receive the various embodiments of closures incorporating the invention are generally provided with necks. e.g. narrowed inlets, having threaded positions for threaded connection with the thread 42 on the inner surface of the inner, lower closure member. It will be apparent to those skilled in the art that the closures of the present invention do not require the threaded portion to be on the neck of a container in order for the invention to operate. Rather, the same closures will operate equally satisfactorily with containers that do not have necks, so long as the portion surrounding the container inlet has a threaded portion that is threadedly connectable with the threads 42 on the inner, lower closure member 14. Thus, for example, the closures of the present invention will function well with a cylindrical container having a threaded surface surrounding the outer wall surface in the area of the container opening.

Convertible closures in accordance with the present invention may be formed of any suitable material such as plastic or metal or a combination of materials and the like and that the invention is not intended to be limited by the material from which the devices are formed.

One of the important advantages of the invention over prior art convertible closures is that the closure cannot be converted from the child-resistant mode to the non-child resistant mode unless the closure is detached from the container. By contrast, in prior art convertible closures, it is possible to convert from the child-resistant mode to the non-child resistant mode when the closure is attached to the container and therefore, a child could intentionally or inadvertently change from the child-resistant mode to the non-child resistant mode and open the container.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A convertible closure for a container, comprising:

an outer closure member having a first child-resistant portion on an inner surface;

a first inner closure member having an inner surface arranged to engage with a neck of the container and a second child-resistant portion arranged to selectively engage and cooperate with said first child-resistant portion such that when engaged and cooperating therewith, the closure has a non-child resistant configuration and when not engaged and cooperating therewith, the closure has a child-resistant configuration; and a second inner closure member arranged to engage with both said outer closure member and said first inner closure member to enable said first inner closure member to be moved between a first position in which said first and second child-resistant portions are in engagement and cooperating with one another and a second position in which said first and second child-resistant portions are not in engagement and cooperating with one another and retain said first inner closure member in a fixed position relative to said outer closure member when said first inner closure member is in said first position, said first inner closure member being configured to be moved in an axial direction of the closure between the first position in which said first and second child-resistant portions are in engagement and cooperating with one another and the second position in which said first and second child-resistant portions are not in engagement and cooperating with one another.

2. The closure of claim 1, wherein said outer closure member has a tubular body and said first child-resistant portion is arranged on an inner surface of said body, and said first inner closure member has a tubular body and said second child-resistant portion is arranged on an outer surface of said body.

3. The closure of claim 1, wherein said first and second child-resistant portions comprise cooperating angular abutments.

4. The closure of claim 1, wherein said outer closure member includes a central opening at an upper portion and said second inner closure member includes a top wall in at least partial alignment with said central opening to enable said second inner closure member to be manually urged from said first position to said second position.

5. The closure of claim 1, further comprising retaining means for releasably retaining said second inner closure member in the fixed position in which said first inner closure member is in said first position.

6. The closure of claim 5, wherein said retaining means comprise a circumferential lip formed on an inner surface of said outer closure member and a circumferential groove formed on an outer surface of said second inner closure member.

7. The closure of claim 1, wherein said first inner closure member includes a tubular body and a circumferential lip extending outward from said body at an upper edge region thereof, said second inner closure member includes a tubular body and a circumferential lip extending inward from said body at a lower edge region thereof and which engages with and displaces said circumferential lip of said first inner closure member, and thus said first inner closure member, when urged upward to thereby move said first inner closure member into said first position.

8. The closure of claim 7, wherein said first inner closure member further includes an abutment portion extending outward from said body at a lower edge region and defining said second child-resistant portion.

9. The closure of claim 8, wherein said outer closure member further includes an intermediate circumferential lip extending inward from said inner surface, said first child-resistant portion being defined below said intermediate lip, said intermediate lip limiting movement of said first second inner closure member.

10. The closure of claim 1, wherein said outer closure member, said first inner closure member and said second inner closure member are coaxial.

11. The closure of claim 1, wherein said second inner closure member has an outer surface alongside said inner surface of said outer closure member.

12. A convertible closure for a container, comprising:

an outer closure member having at least one angular abutment on an inner surface;

a first inner closure member having an inner surface arranged to engage with a neck of the container and an outer surface including at least one angular abutment arranged to selectively engage and cooperate with said at least one angular abutment on said inner surface of said outer closure member; and a second inner closure member arranged to engage with said first inner closure member and enable displacement of said first inner closure member between a first position in which said at least one angular abutment on said outer surface of said first inner closure member is in engagement and cooperating with said at least one angular abutment on said inner surface of said outer closure member and a second position in which all of said at least one angular abutment on said outer surface of said first inner closure member are not in engagement and cooperating with said at least one angular abutment on said inner surface of said outer closure member, said first inner closure member being configured to be displaced in an axial direction of the closure between the first position in which said at least one angular abutment on said outer surface of said first inner closure member is in engagement and cooperating with said at least one angular abutment on said inner surface of said outer closure member and the second position in which all of said at least one angular abutment on said outer surface of said first inner closure member are not in engagement and cooperating with said at least one angular abutment on said inner surface of said outer closure member.

13. The closure of claim 12, wherein said outer closure member includes a plurality of angular abutment on said inner surface and said first inner closure member includes an equal number of angular abutments on said outer surface.

14. The closure of claim 12, wherein said outer closure member includes a central opening at an upper portion and said second inner closure member includes a top wall in at least partial alignment with said central opening to enable said second inner closure member to be manually urged from said first position to said second position.

15. The closure of claim 12, further comprising retaining means for releasably retaining said second inner closure member in a position in which said first inner closure member is in said first position.

16. The closure of claim 15, wherein said retaining means comprise a circumferential lip formed on said inner surface of said outer closure member and a circumferential groove formed on an outer surface of said second inner closure member.

17. The closure of claim 12, wherein said first inner closure member includes a tubular body and a circumferential lip extending outward from said body at an upper edge region thereof, said second inner closure member includes a tubular body and a circumferential lip extending inward from said body at a lower edge region thereof and which engages with and displaces said circumferential lip of said first inner closure member, and thus said first inner closure member, when urged upward to thereby displace said first inner closure member into said first position.

18. The closure of claim 17, wherein said first inner closure member further includes an abutment portion extending outward from said body at a lower edge region and defining said at least one angular abutment on an outer surface thereof.

19. The closure of claim 18, wherein said outer closure member further includes an intermediate circumferential lip extending inward from said inner surface, said at least one angular abutment on said inner surface of said outer closure member being defined below said intermediate lip and such that said abutment portion of said first inner closure member engages with said intermediate lip when said first inner closure member is in said first position.

20. A convertible closure for a container, comprising:

an outer closure member having a tubular body having an opening at an upper edge region and a plurality of angular abutments on an inner surface of said tubular body;

a first inner closure member having a tubular body, means for engaging with a neck of the container formed on an inner surface of said tubular body and a plurality of angular abutments on an outer surface of said tubular body and arranged to selectively engage and cooperate with said angular abutments on said inner surface of said tubular body of said outer closure member; and a second inner closure member arranged to engage with first inner closure member and enable displacement of said first inner closure member between a first position in which said angular abutments on said outer surface of said tubular body of said first inner closure member are in engagement and cooperating with said angular abutments on said inner surface of said tubular body of said outer closure member and a second position in which said angular abutments on said outer surface of said tubular body of said first inner closure member are not in engagement and cooperating with said angular abutments on said inner surface of said tubular body of said outer closure member, said second inner closure member being releasably retained, via cooperation between said second inner closure member and said outer closure member, in a position in which said first inner closure member is in said first position, said first inner closure member being configured to be displaced in an axial direction of the closure between the first position in which said angular abutments on said outer surface of said tubular body of said first inner closure member are in engagement and cooperating with said angular abutments on said inner surface of said tubular body of said outer closure member and the second position in which said angular abutments on said outer surface of said tubular body of said first inner closure member are not in engagement and cooperating with said angular abutments on said inner surface of said tubular body of said outer closure member.

21. A convertible closure for a container, comprising:

an outer closure member;

a first inner closure member having an inner surface arranged to engage with a neck of the container;

a second inner closure member arranged to engage with both said outer closure member and said first inner closure member to enable said first inner closure member to be moved between a first child-resistant position and a second non-child-resistant position; and means for permitting movement of said first inner closure member from the first child-resistant position to the second non-child-resistant position only when the closure is detached from the container.

22. A convertible closure for a container, comprising:

an outer closure member having a first child-resistant portion on an inner surface, said outer closure member including a central opening at an upper portion;

a first inner closure member having an inner surface arranged to engage with a neck of the container and a second child-resistant portion arranged to selectively engage with said first child-resistant portion such that when engaged, the closure has a non-child resistant configuration and when not engaged therewith, the closure has a child-resistant configuration; and a second inner closure member arranged to engage with both said outer closure member and said first inner closure member to enable said first inner closure member to be moved between a first position in which said first and second child-resistant portions are in engagement with one another and a second position in which said first and second child-resistant portions are not in engagement with one another and to retain said first inner closure member in a fixed position relative to said outer closure member when said first inner closure member is in said first position, said second inner closure member including a top wall in at least partial alignment with said central opening of said outer closure member to enable said second inner closure member to be manually urged from said first position to said second position.

23. A convertible closure for a container, comprising:

an outer closure member having a first child-resistant portion on an inner surface;

a first inner closure member having an inner surface arranged to engage with a neck of the container and a second child-resistant portion arranged to selectively engage with said first child-resistant portion such that when engaged, the closure has a non-child resistant configuration and when not engaged therewith, the closure has a child-resistant configuration;

a second inner closure member arranged to engage with both said outer closure member and said first inner closure member to enable said first inner closure member to be moved between a first position in which said first and second child-resistant portions are in engagement with one another and a second position in which said first and second child-resistant portions are not in engagement with one another and to retain said first inner closure member in a fixed position relative to said outer closure member when said first inner closure member is in said first position; and retaining means for releasably retaining said second inner closure member in the fixed position in which said first inner closure member is in said first position, said retaining means comprising a circumferential lip on an inner surface of said outer closure member and a circumferential groove on an outer surface of said second inner closure member.

24. A convertible closure for a container, comprising:

an outer closure member having a first child-resistant portion on an inner surface;

a first inner closure member having an inner surface arranged to engage with a neck of the container and a second child-resistant portion arranged to selectively engage with said first child-resistant portion such that when engaged, the closure has a non-child resistant configuration and when not engaged therewith, the closure has a child-resistant configuration, said first inner closure member including a tubular body and a circumferential lip extending outward from said body at an upper edge region thereof; and a second inner closure member arranged to engage with both said outer closure member and said first inner closure member to enable said first inner closure member to be moved between a first position in which said first and second child-resistant portions are in engagement with one another and a second position in which said first and second child-resistant portions are not in engagement with one another and to retain said first inner closure member in a fixed position relative to said outer closure member when said first inner closure member is in said first position, said second inner closure member including a tubular body and a circumferential lip extending inward from said body at a lower edge region thereof and which engages with and displaces said circumferential lip of said first inner closure member, and thus said first inner closure member, when urged upward to thereby move said first inner closure member into said first position.

25. A convertible closure for a container, comprising:

an outer closure member having a plurality of angular abutments on an inner surface;

a first inner closure member having an inner surface arranged to engage with a neck of the container, said first inner closure member also having an outer surface including a plurality of angular abutments equal in number to said plurality of angular abutments on said inner surface of said outer closure member and that are arranged to selectively engage with said angular abutments on said inner surface of said outer closure member; and a second inner closure member arranged to engage with said first inner closure member and enable displacement of said first inner closure member between a first position in which said angular abutments on said outer surface of said first inner closure member is in engagement with said angular abutments on said inner surface of said outer closure member and a second position in which all of said angular abutments on said outer surface of said first inner closure member are not in engagement with said angular abutments on said inner surface of said outer closure member.

26. A convertible closure for a container, comprising:

an outer closure member having at least one angular abutment on an inner surface, said outer closure member including a central opening at an upper portion;

a first inner closure member having an inner surface arranged to engage with a neck of the container and an outer surface including at least one angular abutment arranged to selectively engage with said at least one angular abutment on said inner surface of said outer closure member; and a second inner closure member arranged to engage with said first inner closure member and enable displacement of said first inner closure member between a first position in which said at least one angular abutment on said outer surface of said first inner closure member is in engagement with said at least one angular abutment on said inner surface of said outer closure member and a second position in which all of said at least one angular abutment on said outer surface of said first inner closure member are not in engagement with said at least one angular abutment on said inner surface of said outer closure member, said second inner closure member including a top wall in at least partial alignment with said central opening of said outer closure member to enable said second inner closure member to be manually urged from said first position to said second position.

27. A convertible closure for a container, comprising:

an outer closure member having at least one angular abutment on an inner surface;

a first inner closure member having an inner surface arranged to engage with a neck of the container and an outer surface including at least one angular abutment arranged to selectively engage with said at least one angular abutment on said inner surface of said outer closure member;

a second inner closure member arranged to engage with said first inner closure member and enable displacement of said first inner closure member between a first position in which said at least one angular abutment on said outer surface of said first inner closure member is in engagement with said at least one angular abutment on said inner surface of said outer closure member and a second position in which all of said at least one angular abutment on said outer surface of said first inner closure member are not in engagement with said at least one angular abutment on said inner surface of said outer closure member; and retaining means for releasably retaining said second inner closure member in a position in which said first inner closure member is in said first position, said retaining means comprising a circumferential lip on said inner surface of said outer closure member and a circumferential groove on an outer surface of said second inner closure member.

28. A convertible closure for a container, comprising:

an outer closure member having at least one angular abutment on an inner surface;

a first inner closure member having an inner surface arranged to engage with a neck of the container and an outer surface including at least one angular abutment arranged to selectively engage with said at least one angular abutment on said inner surface of said outer closure member, said first inner closure member including a tubular body and a circumferential lip extending outward from said body at an upper edge region thereof; and a second inner closure member arranged to engage with said first inner closure member and enable displacement of said first inner closure member between a first position in which said at least one angular abutment on said outer surface of said first inner closure member is in engagement with said at least one angular abutment on said inner surface of said outer closure member and a second position in which all of said at least one angular abutment on said outer surface of said first inner closure member are not in engagement with said at least one angular abutment on said inner surface of said outer closure member, said second inner closure member including a tubular body and a circumferential lip extending inward from said body at a lower edge region thereof and which engages with and displaces said circumferential lip of said first inner closure member, and thus said first inner closure member, when urged upward to thereby displace said first inner closure member into said first position.

* * * * *